US008173944B2

(12) United States Patent
Kanbara et al.

(10) Patent No.: US 8,173,944 B2
(45) Date of Patent: May 8, 2012

(54) COOKING DEVICE

(75) Inventors: Seiji Kanbara, Nishinomiya (JP); Seiichi Hirano, Osaka (JP); Kenji Kimura, Yao (JP); Tatsuhiko Nakamura, Osaka (JP); Tohru Fujikawa, Kaizuka (JP)

(73) Assignee: Sharp Kabushiki Kaisha, Osaka (JP)

( * ) Notice: Subject to any disclaimer, the term of this patent is extended or adjusted under 35 U.S.C. 154(b) by 178 days.

(21) Appl. No.: 12/361,747

(22) Filed: Jan. 29, 2009

(65) Prior Publication Data

US 2009/0188912 A1 Jul. 30, 2009

(30) Foreign Application Priority Data

Jan. 30, 2008 (JP) ..... 2008-019808

(51) Int. Cl.
*H05B 6/66* (2006.01)

(52) U.S. Cl. ..... 219/702

(58) Field of Classification Search ..... 219/702, 219/737, 722, 681, 10.55, 413
See application file for complete search history.

(56) References Cited

U.S. PATENT DOCUMENTS

| | | | | |
|---|---|---|---|---|
| 5,877,477 | A * | 3/1999 | Petty et al. | 219/506 |
| 6,878,912 | B2 * | 4/2005 | Lee et al. | 219/707 |
| 2006/0289512 | A1 * | 12/2006 | Iwamoto | 219/722 |

FOREIGN PATENT DOCUMENTS

| | | | |
|---|---|---|---|
| JP | 59-12592 | | 1/1984 |
| JP | 60-191134 | * | 9/1985 |
| JP | 3-271623 | A | 12/1991 |
| JP | 4-121519 | A | 4/1992 |
| JP | 05-34699 | | 5/1993 |
| JP | 11-201470 | A | 7/1999 |
| JP | 2004-324993 | A | 11/2004 |
| JP | 2005-003273 | * | 1/2005 |
| JP | 2005-3273 | | 1/2005 |
| JP | 2005-122961 | A | 5/2005 |
| JP | 2006-105427 | | 4/2006 |
| JP | 2007-17011 | | 1/2007 |

* cited by examiner

*Primary Examiner* — Tu B Hoang
*Assistant Examiner* — Thien S Tran
(74) *Attorney, Agent, or Firm* — Birch, Stewart, Kolasch & Birch, LLP

(57) ABSTRACT

In a cooking device for cooking an object to be heated, a first operation section is provided to a lower portion of a door, and a second operation section is provided to an upper portion on a front face of a cooking device body so as to be exposed in spite of the door being opened or closed. Numeric keys for accepting a selection from a plurality of recipes stored in advance and start keys for accepting a start of heating are provided to the first and second operation sections redundantly. Therefore, in a case of when the door closes, the first and second operation sections can be used in parallel, allowing arrangement of many keys to have good operability.

6 Claims, 15 Drawing Sheets

COOKING DEVICE

CROSS-REFERENCE TO RELATED APPLICATION(S)

This Nonprovisional application claims priority under 35 U.S.C. §119(a) on Patent Application No. 2008-19808 filed in Japan on Jan. 30, 2008, the entire contents of which are hereby incorporated by reference.

BACKGROUND OF THE INVENTION

1. Field of the Invention

The present invention relates to a cooking device which has a heat source for a microwave, an electric heater and the like to cook an object to be heated in a heating chamber.

2. Description of Related Art

In recent years, the cooking devices provided with the microwave and the electric heater as the heat source have become widespread. Of these cooking devices, the mainstream for domestic use is one which detects the condition of an object to be heated by a sensor and optimally heats automatically. On the other hand, it is required for a cooking device for professional use to be easily operated by selecting from recipes (combinations of the heating time and heating power corresponding to the kind and amount of the object to be heated) set in advance. Further, there is also a request on which cooking devices can be used in a state of placing one on top of another one in order to use effectively within a limited installation space. In any of these applications, usability of the cooking device greatly depends on the arrangement of operation sections and operation switches; thus, the arrangements thereof are devised variously.

As for the operation section of the cooking device, a general one is configured such that a plurality of operation switches are concentrated in one place in the front face of a cooking device body. Some cooking devices have two operation sections arranged apart from each other depending on the functions assigned to the operation switches or the frequency of use of the operation switches. Further, some devices have two operation sections which are arranged in different places of the cooking device body and have the operation switches assigned with the functions a part of which are overlapped.

For example, Japanese Patent Application Laid-Open No. 03-271623 discloses the heating cooking device in which the operation section is arranged at the front face of the cooking device body, and the operation section is provided with the operation switch of high (or low) frequency of use such that the operation section is exposed (or hidden) when the door opens (or closes). In addition, Japanese Patent Application Laid-Open No. 11-201470 discloses a technique with which the operation section provided with the operation switch of high (or low) frequency of use is arranged at a portion higher or lower than the display section provided on the front face of the cooking device body. Further, Japanese Patent Application Laid-Open No. 2005-122961 discloses a technique with which a first operation section provided with the operation switch for accepting the start of automatic cooking is arranged at the front face of the cooking device body, and a second operation section provided with the operation switch for accepting the start and the end of heating is arranged at the top face of the cooking device body.

BRIEF SUMMARY OF THE INVENTION

However, in the heating cooking device disclosed in Japanese Patent Application Laid-Open No. 03-271623, since one of the operation sections which is hidden cannot be operated when the door is closed, in a case of, for example, being operated in a state where one is placed on top of another one for professional use and the door is closed, it is impossible to use two operation sections in parallel or selectably depending on the purpose of the operation and the posture of operator while in operation. Further, in the technique disclosed in Japanese Patent Application Laid-Open No. 11-201470 or 2005-122961, since any operation section is arranged at the cooking device body side, a space and area for installing the operation sections is limited, leading to the number of operation switches becoming limited, which can otherwise be arranged to two operation sections with good operability.

The present invention is made in consideration of the above circumstances, and is to provide a cooking device in which a first operation section is provided to a door and a second operation section is provided to an exposed part of the cooking device body, which makes it possible to use the respective two operation sections in parallel or selectably in accordance with the purpose of the operation and the posture of operator while in operation, allowing arrangement of many operation switches having good operability, even when the door is closed.

An aspect of the present invention, a cooking device includes a cooking device body including therein a heating chamber having a door for openably closing the heating chamber and heating means for heating an object to be heated inside the heating chamber, and a plurality of operation sections for accepting an operation to control the heating means. The operation sections include a first operation section provided to the door, and a second operation section provided to the cooking device body so as to be exposed in spite of the door being opened and closed. The first operation section is provided to the door, and the second operation section is provided to the cooking device body so as to be exposed in spite of the door being opened or closed. Operations for the respective operation sections are accepted in spite of the door being opened or closed, enabling the increase of the total number and degree of freedom of arrangement of the operation switches included in the operation sections.

In the cooking device of this aspect of the invention, the first operation section may be provided in a lower portion of the door, and the second operation section may be provided in an upper portion of a front face of the cooking device body. It can be intended that the operation switches included in the two operation sections separated vertically from each other are used in parallel or selectably in consideration of the functions assigned to the operation switches and the operability of the switches.

In the cooking device of this aspect of the invention, the first and second operation sections may have an operation switch assigned with an identical function redundantly, respectively. The operation switch included in the first and second operation sections may be assigned with identical function redundantly. Any operation section can accept the function which is assigned to overlap the operation switch included in the respective operation sections. Thus, for example, when it is difficult to operate one of the operation sections, a user can perform the same operation to the other operation section.

In the cooking device of this aspect of the invention, the identical function may be a selection of a recipe and start of heating. The operation switch included in the first and second operation sections may be assigned with function of selecting the recipe or to start heating redundantly. Selection from a plurality of recipes or the start of heating can be accepted by any operation section. Thus, for example, in a case of placing the cooking device on top of another one, when the user operates the upper and lower cooking devices, the user can operate the selection of the recipe or the start of heating in a natural posture with the operation sections arranged at the lower portion of the door and the upper portion of the body of the respective devices.

In the cooking device of this aspect of the invention, one of the first and second operation sections may have an operation switch assigned with a function that is not assigned to an operation switch of the other operation section. One of the first and second operation sections may be provided with the operation switch assigned with the function the same as which are not assigned to the operation switch provided to the other operation section. Operation for the function not overlapping can be accepted by only one of the operation sections. Therefore, for example, the operation section including the operation switch assigned with the function used by only the manager can be separated from the operation section operated by the worker.

In the cooking device of this aspect of the invention, the function that is not assigned to the operation switch of the other operation section may be to assign a function to other operation switch. One of the first and second operation sections may be provided with the operation switch for assigning the function to other operation switch. Assignment of the function to other operation switch can be accepted by only one of the operation sections. Therefore, for example, only to the operation section operated by the manager, the operation switch can be provided for assigning the function to other operation switch.

The cooking device of this aspect of the invention may further include detecting means for detecting opening and closing of the door, and invalidating means for invalidating the acceptance of the operation to the first operation section when the detecting means detects the door being opened. When the detecting means detects the door opens, the invalidating means invalidates an operation to the first operation section. When the door is opened, the operation to the first operation section can not be accepted. Therefore, for example, when the user opens the door, safety is secured in a case of touching the operation switch by mistake.

The cooking device of this aspect of the invention may further include time counting means for starting a time count when the detecting means detects the door being closed. The invalidating means may invalidate the acceptance of the operation to the first operation section until the time counting means counts a predetermined time period from the starting of the time count. When the detecting means detects the door closes, until the time counting means finishes counting for the predetermined time period, the invalidating means invalidates acceptance of operations to the first operation section. Thus, when the door is closed, operations to the first operation section shall not be accepted for the predetermined time period. Therefore, even when the switches on the operation section gets depressed by user's mistake while closing the door, safety is secured.

According to the invention, the first operation section is provided to the lower position of the door and the second operation section is provided to the top part of the front of the cooking device so as to keep the latter uncovered and accessible regardless of door open/close position, respectively. This makes it possible for the operations to the respective operation sections to be accepted in spite of the door being opened or closed, thus enabling the increase of the total number and the degree of freedom of arrangement of the operation switches included in the operation sections. Therefore, in a case of when the door closes, the respective operation sections can be used in parallel or selectably depending on the purpose of the operation and the posture of the operator while in operation, allowing arrangement of many operation switches to have good operability.

The above and further objects and features of the invention will more fully be apparent from the following detailed description with accompanying drawings.

DETAILED DESCRIPTION OF THE INVENTION

Hereinafter, detailed description will be given of a microwave oven as an embodiment of a cooking device according to the invention.

Embodiment 1

Figure 1:
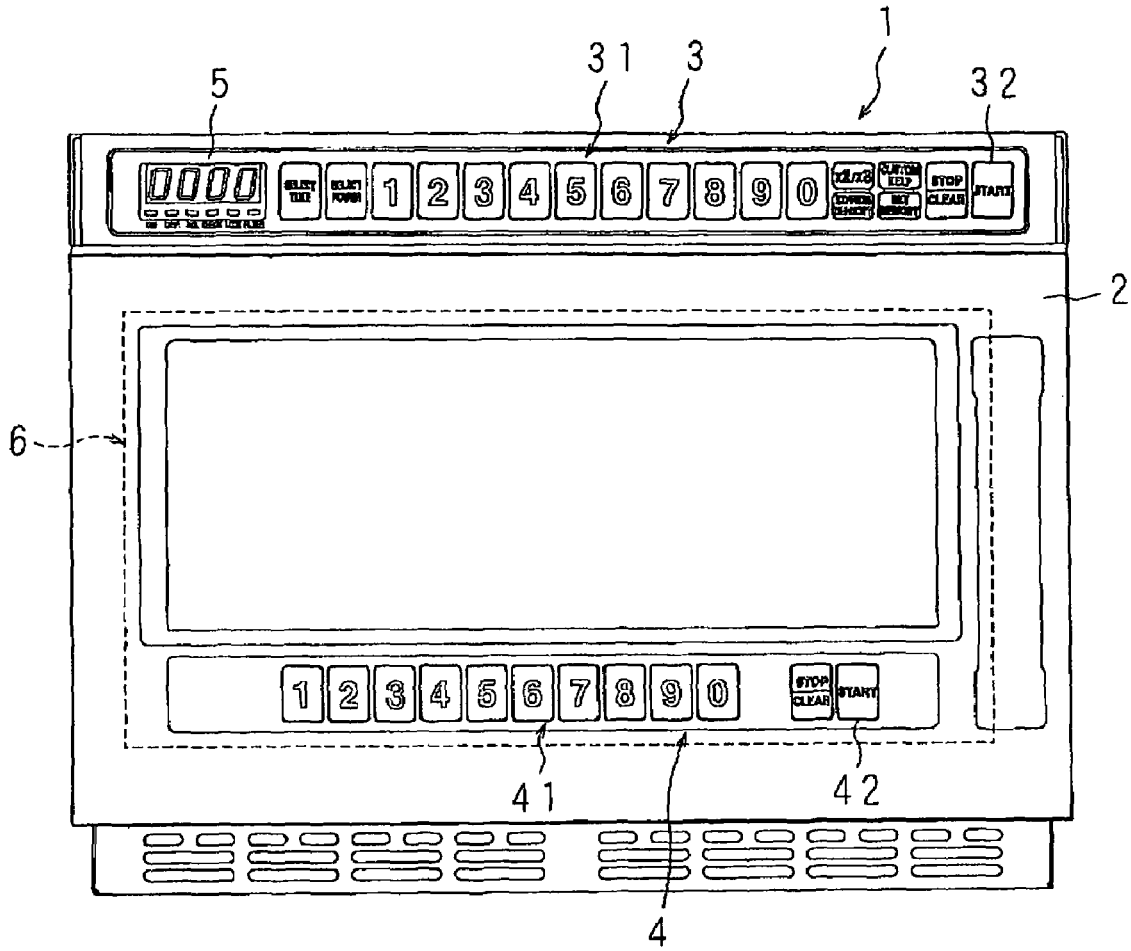
FIG. 1 is a front view showing an appearance of a microwave oven according to Embodiment 1 of the invention.
Figure 2:
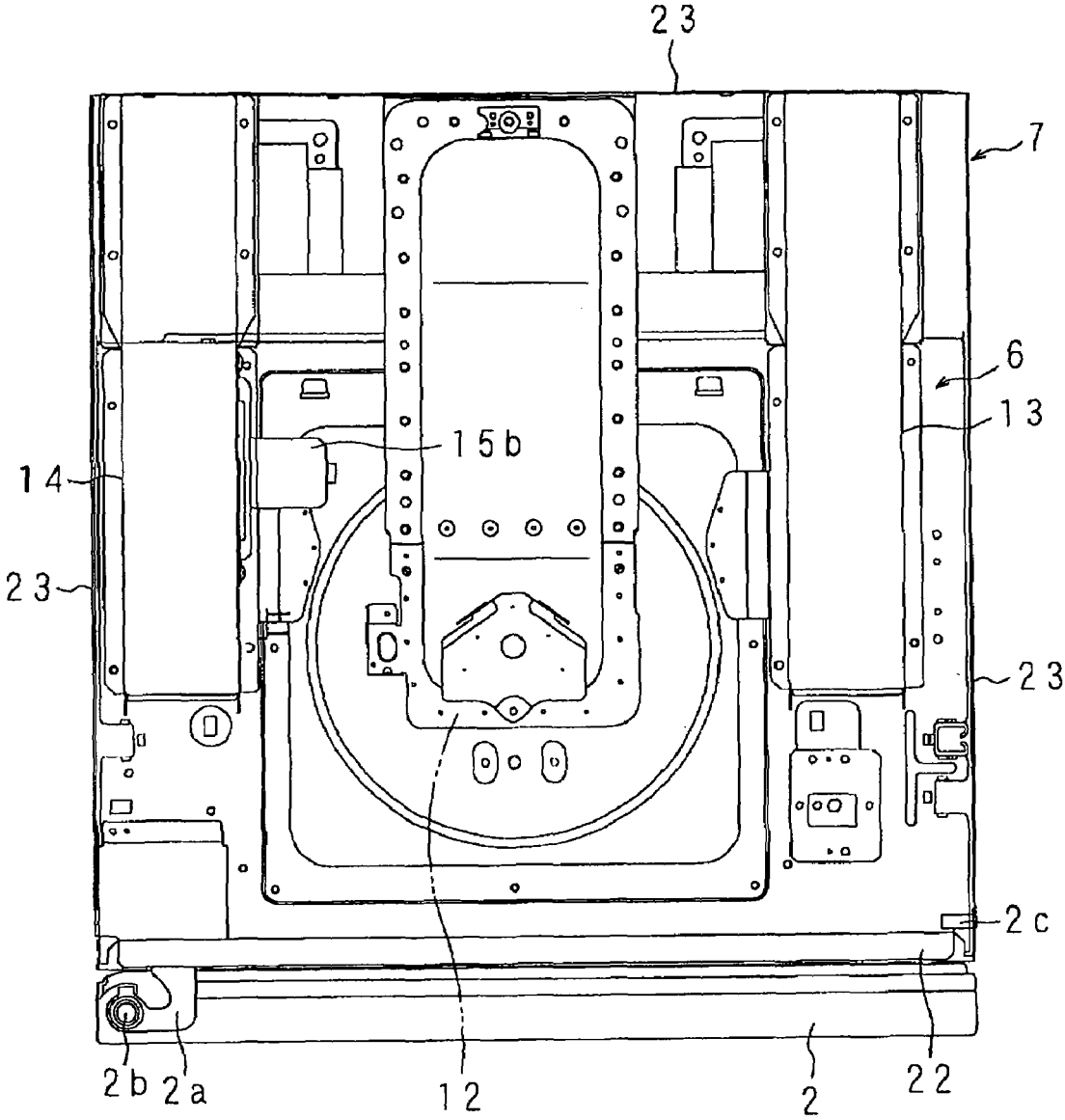
FIG. 2 is a schematic plan view showing an internal constitution of the microwave oven.
Figure 3:
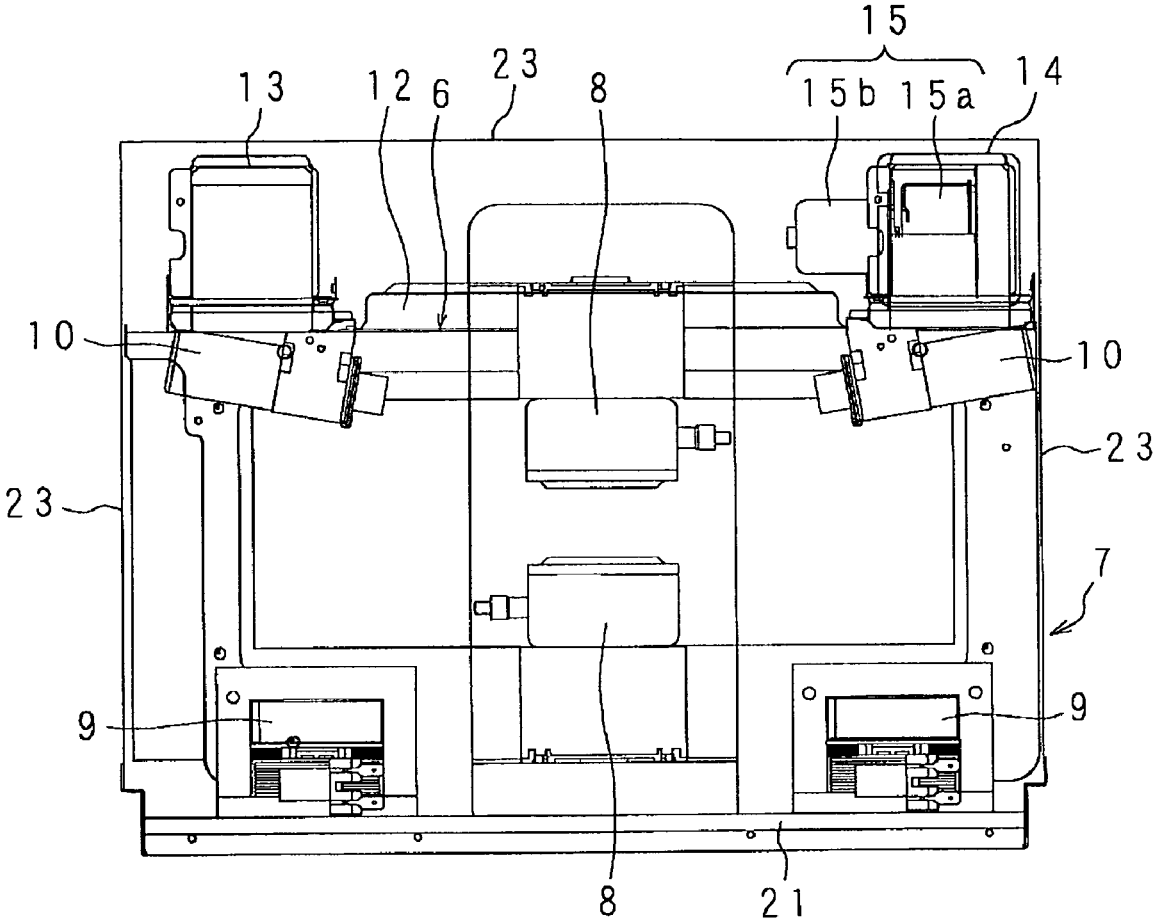
FIG. 3 is a schematic back view showing an internal constitution of the microwave oven.
Figure 4:
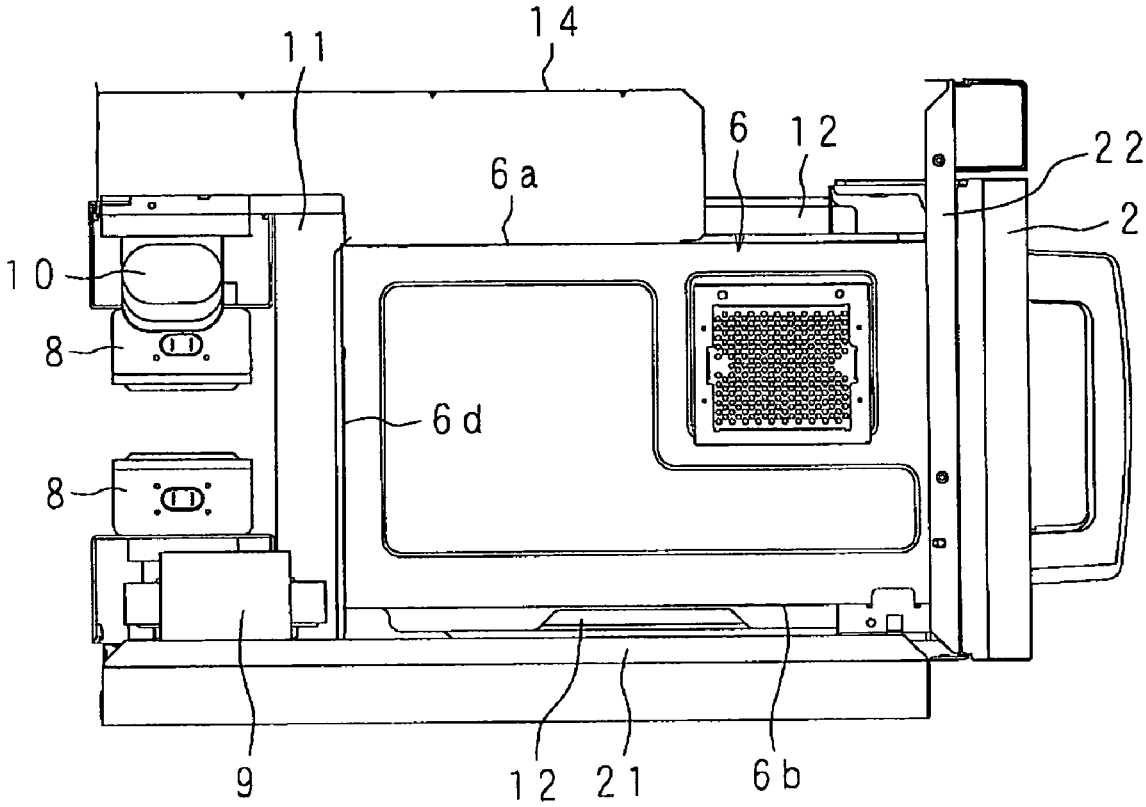
FIG. 4 is a schematic left side view showing an internal constitution of the microwave oven.
Figure 5:
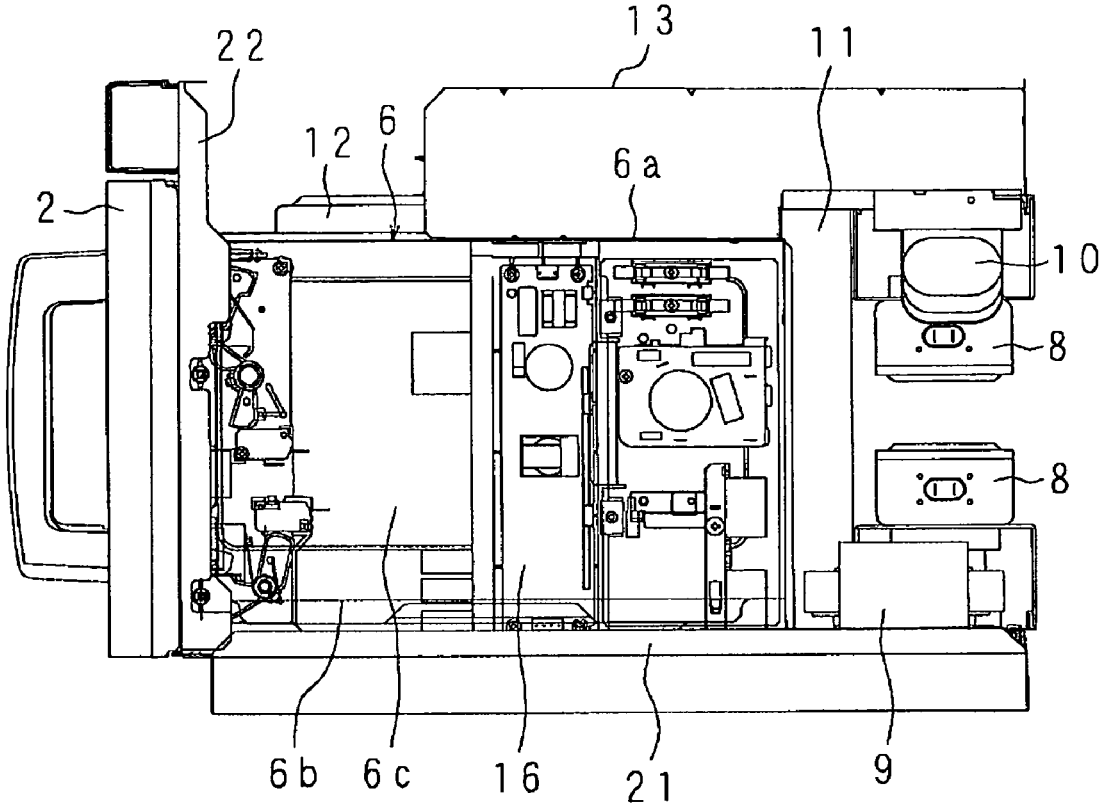
FIG. 5 is a schematic right side view showing an internal constitution of the microwave oven.

FIG. 1 is a front view showing an appearance of a microwave oven according to Embodiment 1 of the invention. FIGS. 2 to 5 are a schematic plan view, schematic back view, schematic left side view and schematic right side view showing an internal constitution of the microwave oven, respectively.

Numeral 1 represents an oven body in the figure. The oven body 1 has a shape of approximate rectangular parallelepiped, and has as an outer envelope cabinet 7 accommodating a heating chamber 6 having an open section on the front side thereof. The open section is closed by a door 2 such that it is capable of being opened and closed by the door 2 which is attached to one side of the front part of the oven body 1 so as to hinge and horizontally swing. An upper portion of the front face of the oven body 1 is protruded forward to cover the top portion of the door 2, and the protruded front part of the oven body 1 and the lower portion of the door 2 are provided with operation sections 3 and 4, respectively, for accepting an operation such as the selection of a recipe and the start of heating.

The cabinet 7 includes a base 21 which has a rectangular shape at the bottom, a front frame 22 which has a frame shape and is coupled to the front edge portion of the base 21, and a cover body 23 which has both side panels, a top panel and a rear panel and covers the edges of the base 21 and the front frame 22. The heating chamber 6 is arranged at the front portion of the base 21. The door 2 is supported by a hinge pin 2*b* which is fitted in a hinge 2*a* (a lower side of which is not shown) provided to the upper and lower parts of one side of the front frame 22, and on the other side of the front frame 22 provided is a door switch 2*c* for detecting the opening and closing of the door 2.

In the center on the back of the heating chamber 6, provided are two magnetrons 8 apart from each other on the upper and lower portions for generating the microwave for heat cooking. On the back of the heating chamber 6 at the lower portion on both sides, provided are transformers 9 for feeding electricity to the respective magnetrons 8, and on the back of the heating chamber 6 at the upper portion on both sides, provided are capacitors 10 for smoothing outputs of the respective transformers 9. The heating chamber 6 has a rear wall 6*d*, a back surface of which two cooling fan motors 11 are provided on. The heating chamber 6 has a top wall 6*a*, an upper surface of which a waveguide 12 is provided on, and has a bottom wall 6*b*, an under surface of which another waveguide 12 is provided on; the waveguides used for feeding the microwave generated by the magnetrons 8 to the heating chamber 6.

On the upper surface of the top wall 6*a* of the heating chamber 6, provided are an air supply duct 13 for supplying external air to the heating chamber 6 and an exhaust duct 14 for discharging exhaust air from the heating chamber 6. The exhaust duct 14 has a fan 15 in the exhaust passage thereof. The fan 15 includes a bladed wheel 15*a* in the duct and an exhaust motor 15*b* for driving the bladed wheel 15*a*. The heating chamber 6 has a side wall 6*c*, an outer surface of which a control section 16 is provided on for controlling electrical components such as the operation sections 3 and 4, and the magnetrons 8.

Figure 6:
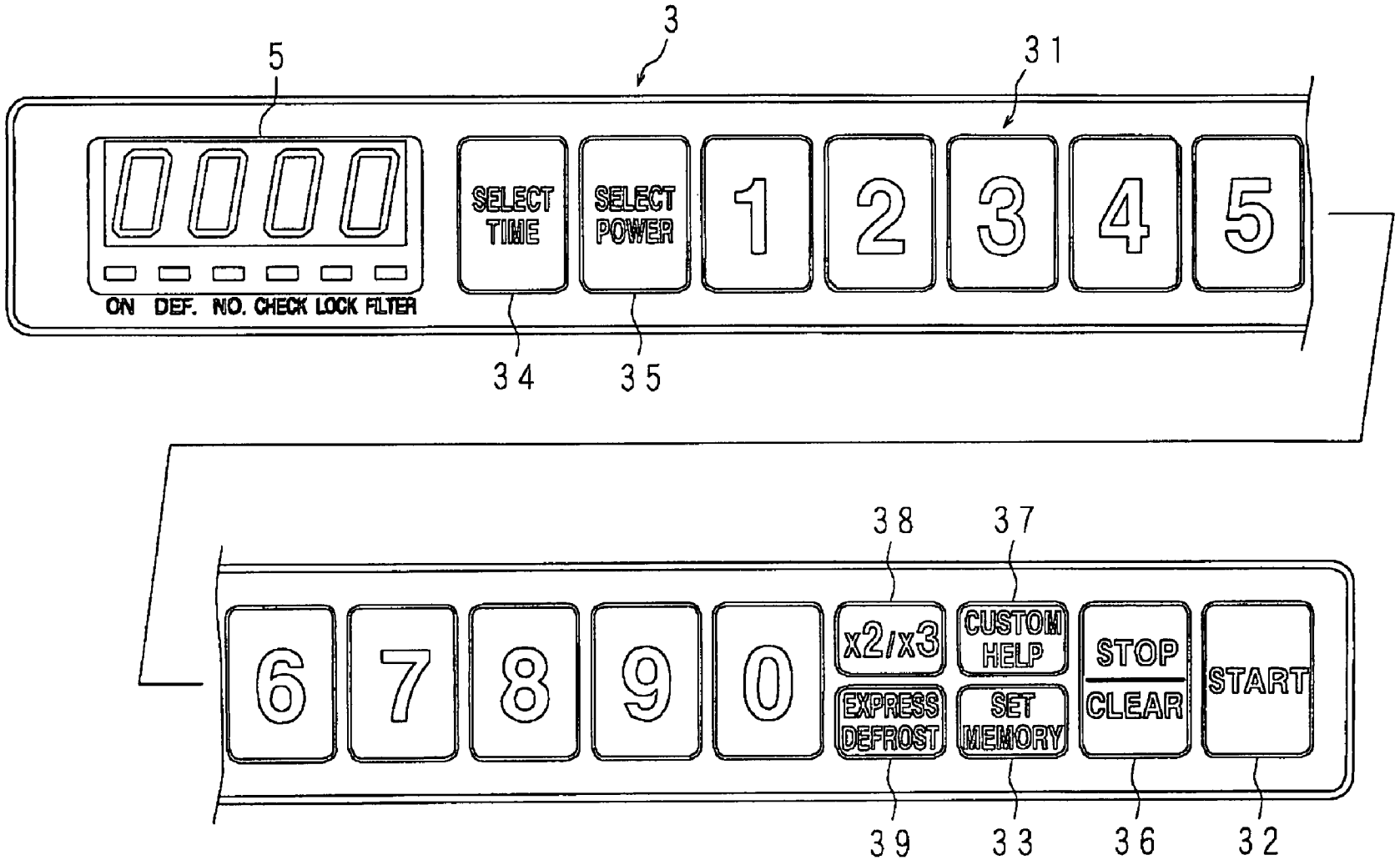
FIG. 6 is an illustration showing an appearance of an operation section arranged at the oven body of the microwave oven.

FIG. 6 is an illustration showing an appearance of the operation section 3 (second operation section) arranged at the oven body 1 of the microwave oven. The operation section 3 includes numeric keys 31 having keys from "0" to "9" for accepting the selection from the recipes stored in advance, a start key 32 and a stop/clear key 36 for accepting the start and the stopping of heating respectively for the recipe corresponding to the numeric value selected with the numeric key 31, and an indicator 5 for indicating information such as the contents accepted from the respective keys and the remaining time of the heating.

The operation section 3 includes, for a case of setting and storing the recipe corresponding to the numeric value, a set memory key 33 for accepting a memory of the set recipe, a time set key 34 for accepting a setting of a cooling time for the recipe being set, and a power set key 35 for accepting a setting of a heating power for the recipe being set. The operation section 3 further includes a help key 37 for displaying the setting contents of the stored recipe in the indicator 5, a twice/thrice set key 38 for temporally accepting twice or thrice amounts of a predetermined weight of an object to be heated in a case that the weight of the object to be heated exceeds a predetermined weight thereof on setting the recipe, and an express defrosting key 39 for accepting a time setting for rapidly defrosting.

Figure 7:
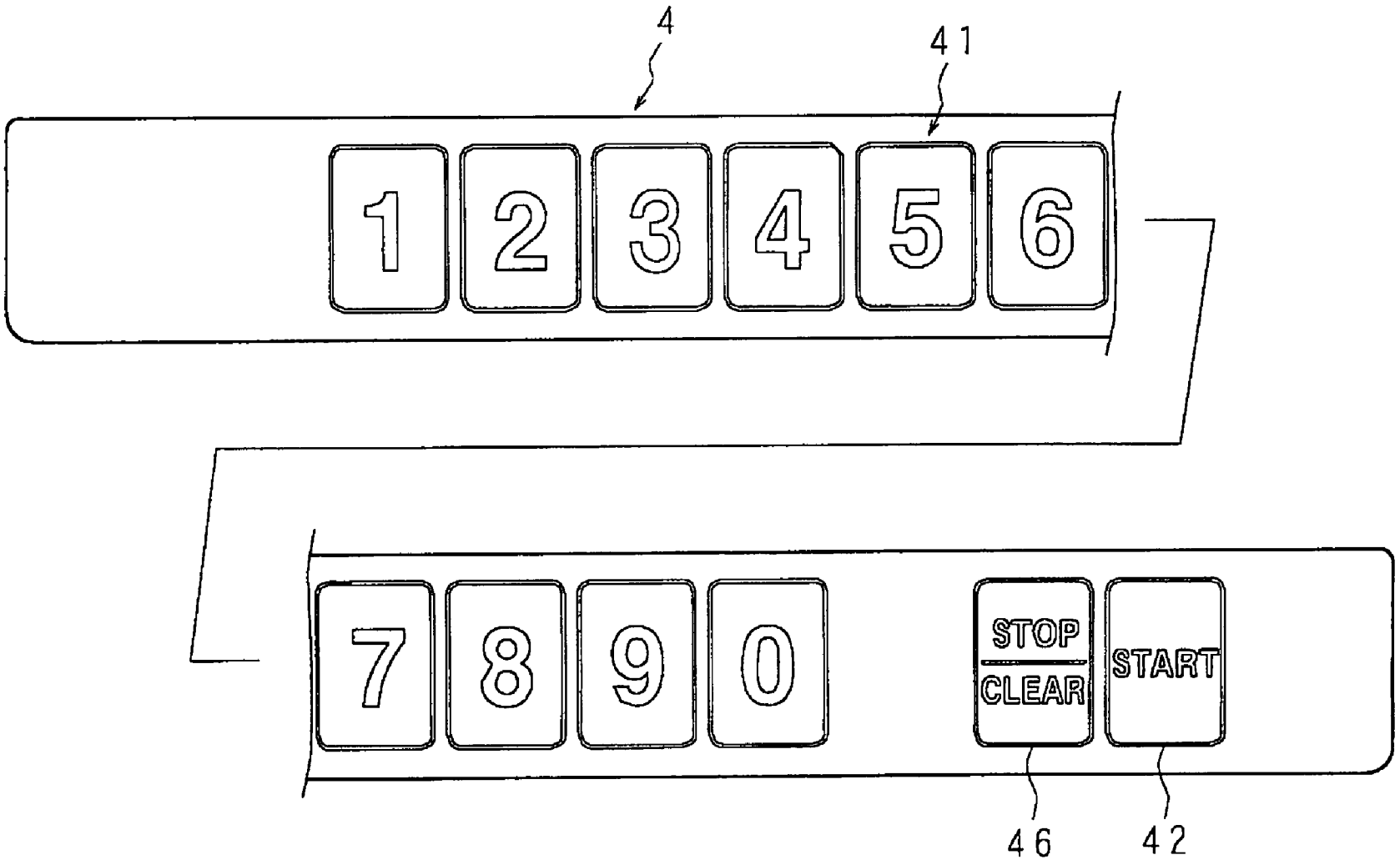
FIG. 7 is an illustration showing an appearance of an operation section arranged at a door of the microwave oven according to Embodiment 1.

FIG. 7 is an illustration showing an appearance of the operation section 4 (first operation section) arranged at the door 2 of the microwave oven according to Embodiment 1. The operation section 4 includes numeric keys 41 having keys from "0" to "9" for accepting the selection from the recipes stored in advance, and a start key 42 and a stop/clear key 46 for accepting the start and stop of heating respectively for the recipe corresponding to the numeric value selected with the numeric key 41. The identical numeric value selected with the numeric key 31 and the numeric key 41 is assigned to the identical recipe. Each recipe can be selected with any of the numeric keys 31 and 41. In addition, the start and stop of heating of the selected recipe can be accepted with either of the start keys 32 and 42, and either of the stop/clear keys 36 and 46, respectively.

Figure 8:
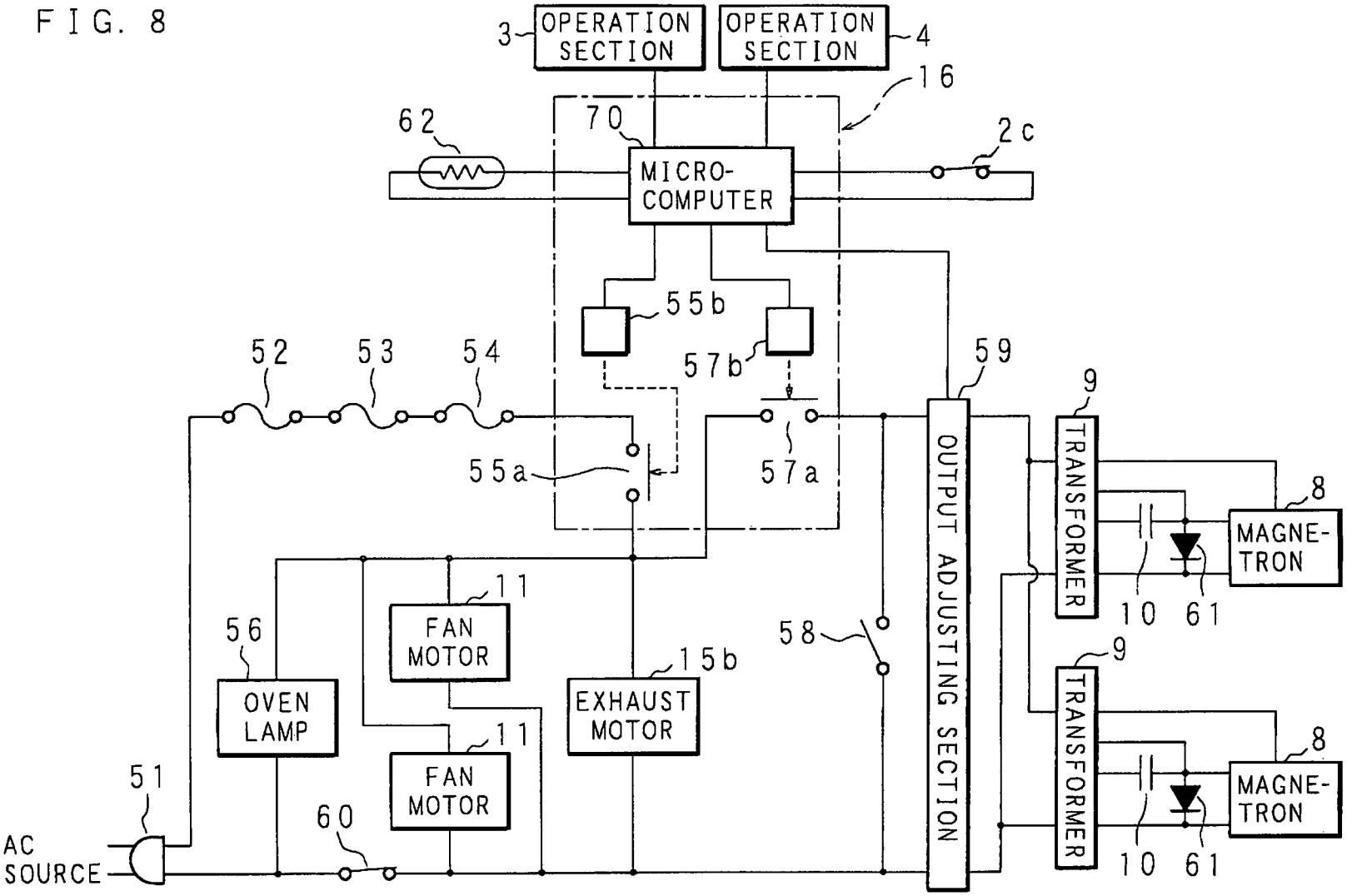
FIG. 8 is a block diagram showing a circuit constitution of a substantial part of the microwave oven.

FIG. 8 is a block diagram showing a circuit constitution of a substantial part of the microwave oven. A first terminal connected to a single phase AC source is connected with a first terminal of an oven lamp 56 for lighting inside the heating chamber 6, via a power supply plug 51, a monitor fuse 52 for fusing when a monitor switch 58 described later is on, a thermal fuse 53 for fusing when the temperature inside the heating chamber 6 is high, a thermal fuse 54 for fusing when the temperature of the magnetrons 8 is high, and an oven relay contact 55*a* which is switched on when the object is heated.

The first terminal of the oven lamp 56 is also connected with the fan motors 11, the exhaust motor 15*b*, and a first terminal of an interlock relay contact 57*a* which is switched off except during normal heating. Additionally, a second terminal of the interlock relay contact 57*a* is connected with a first terminal of the monitor switch 58 which is switched on when the door 2 opens and an input-side first terminal of an output adjusting section 59 for adjusting the output of the magnetrons 8.

A second terminal connected to the AC source is connected with a second terminal of the oven lamp 56 and a first terminal of an interlock switch 60 which is switched off when the door 2 opens, via the power supply plug 51. Further, a second terminal of the interlock switch 60 is connected with the fan motors 11, the exhaust motor 15*b*, the monitor switch 58, and an input-side second terminal of the output adjusting section 59. The output adjusting section 59 on the output side thereof is connected with the two transformers 9 on the primary side thereof in parallel. The transformers 9 on the secondary side thereof are connected via the capacitors 10 with diodes 61 and the magnetrons 8, respectively.

Incidentally, in Embodiment 1, the output adjusting section 59 makes conducting electricity on and off to the transformers 9 with a duty ratio corresponding to the output. However, electricity fed to the transformers 9 may be adjusted by an inverter circuit not by the output adjusting section. The control section 16 is mainly configured by a microcomputer 70, which is connected with an oven relay driving circuit 55*b*, an interlock relay driving circuit 57*b*, the door switch 2*c*, the output adjusting section 59, a humidity sensor 62 for detecting humidity inside the heating chamber 6 and the two operation sections 3 and 4.

Figure 9:
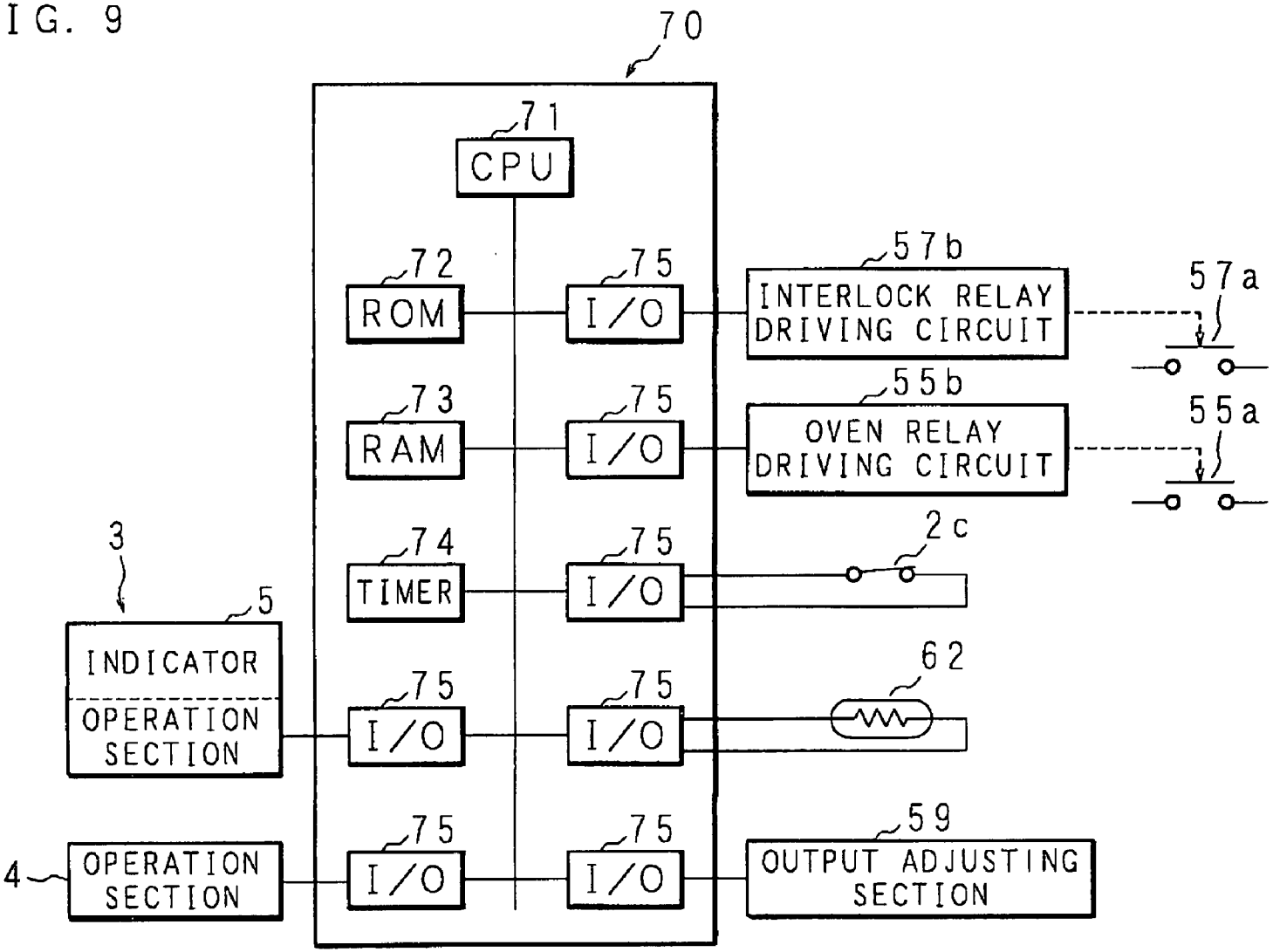
FIG. 9 is an illustration showing a schematic configuration of a microcomputer.

FIG. 9 is an illustration showing a schematic configuration of the microcomputer 70. The microcomputer 70 is constituted by a CPU 71 which is the core for control, a ROM 72 for storing information such as a computer program, a RAM 73 a part of which is configured by a nonvolatile memory and storing information generated during the execution of the computer program, a timer 74 for counting time and I/O ports 75, which are bus-connected with each other The CPU 71 executes processes such as calculation, and input and output according to a control program stored in the ROM 72 in advance.

To the respective I/O ports 75 of the microcomputer 70, as described above, connected are the interlock relay driving circuit 57*b*, the oven relay driving circuit 55*b*, the door switch 2*c*, the humidity sensor 62, the output adjusting section 59 and the two operation sections 3 and 4. The input and output with the indicator 5 is conducted via the operation section 3 connected with one of the I/O ports 75.

In a case where an operation for heating is made to the operation section 3 or 4 with the door 2 being closed in FIGS. 8 and 9, the CPU 71 of the microcomputer 70 accepts the operation via the I/O port 75, and drives via the I/O ports 75, the interlock relay driving circuit 57*b*, and the oven relay driving circuit 55*b* to switch on the interlock relay contact 57*a* and the oven relay contact 55*a*, respectively. This makes the output adjusting section 59 to be connected with the AC source. Then, the output adjusting section 59, of which the output is adjusted by the CPU 71 via the I/O port 75, feeds electricity via the transformers 9 to the magnetrons 8.

In a case of opening the door 2 during heating, the interlock switch 60 is switched off, and the connection between the AC source, and the fan motors 11, the exhaust motor 15*b* and the output adjusting section 59 is broken. Further, the monitor switch 58 is switched on to short-circuit the input side of the output adjusting section 59 such that electricity may not be fed to the output side.

Figure 10:
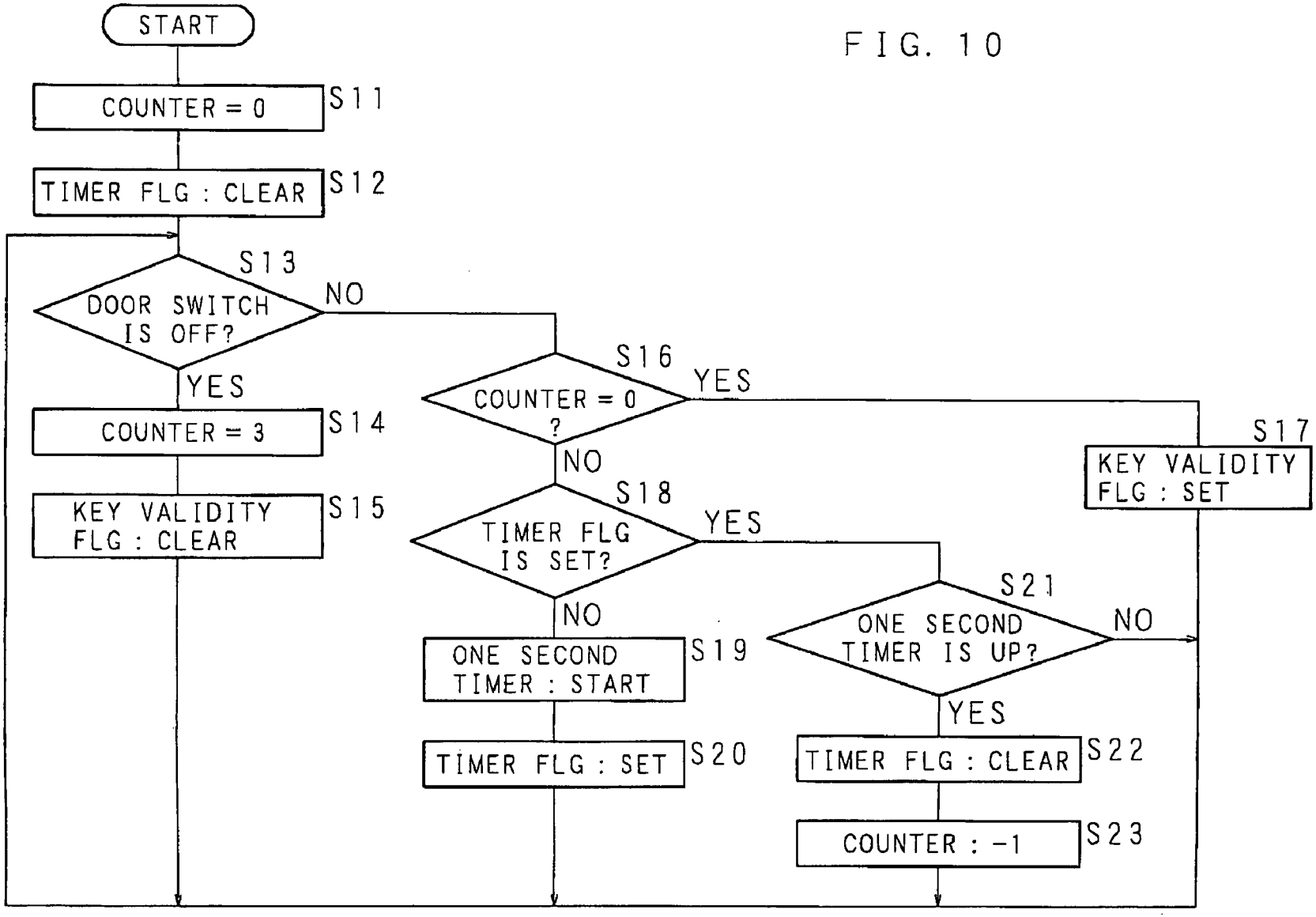
FIG. 10 is a flowchart showing a process procedure of a CPU which detects open and close of the door and sets whether or not an operation key is acceptable.
Figure 11:
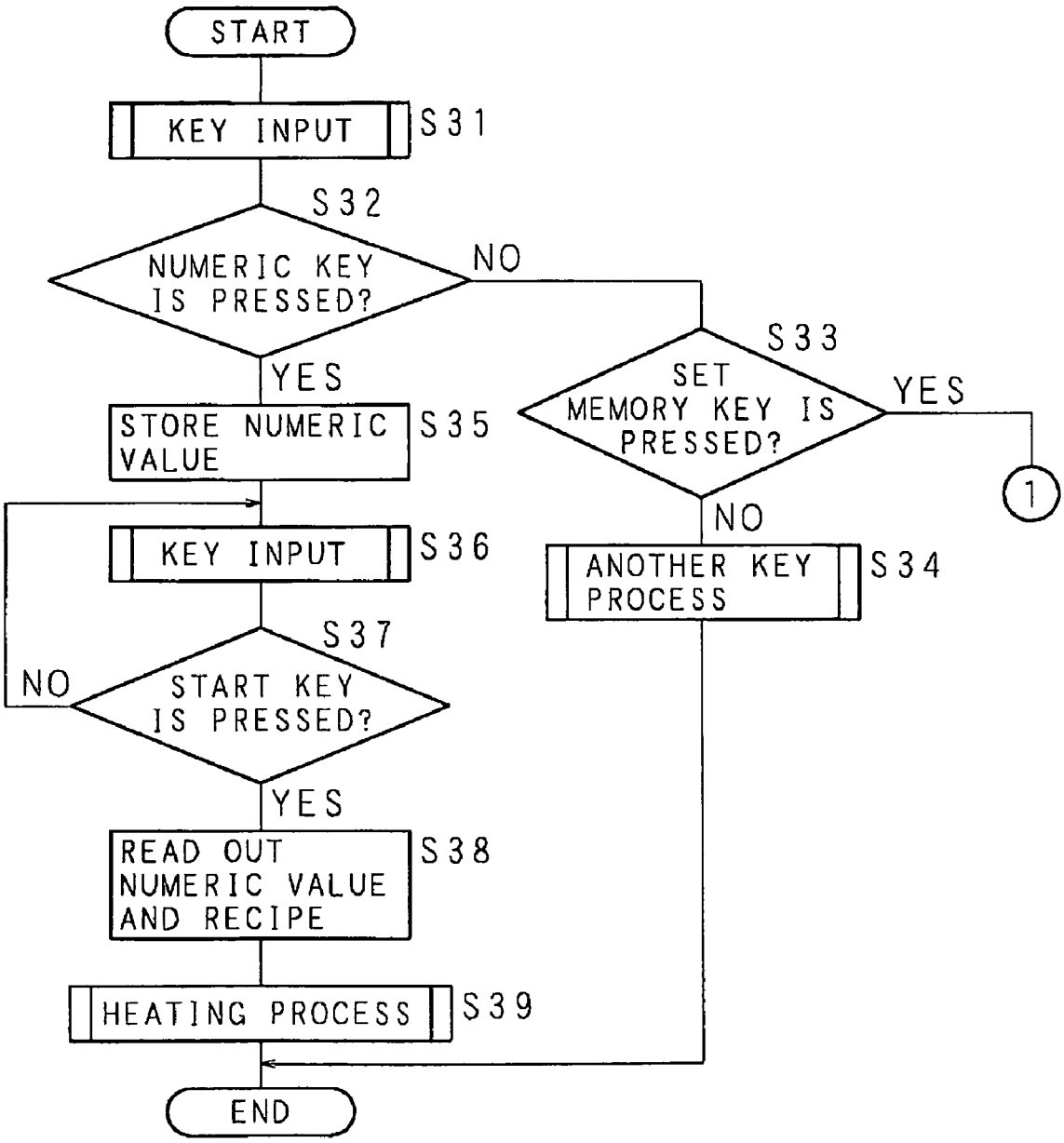
FIG. 11 is a flowchart showing process procedures of the CPU for the acceptance of setting, storing and selection of a recipe.
Figure 12:
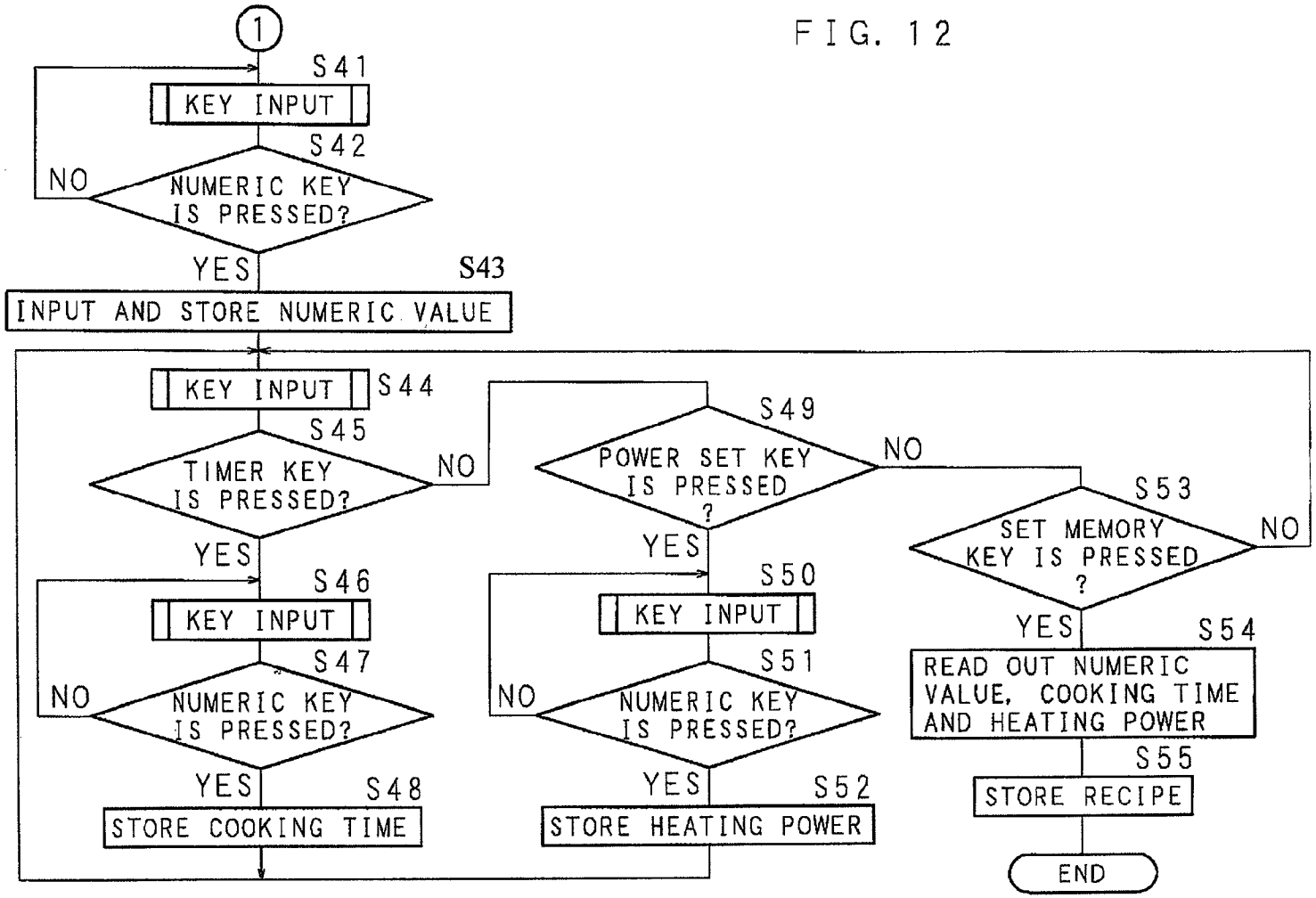
FIG. 12 is a flowchart showing the process procedures of the CPU for the acceptance of the setting, storing and selection of the recipe.

FIG. 10 is a flowchart showing a process procedure of the CPU 71 which detects open and close of the door 2 and sets whether or not the operation key is acceptable. FIGS. 11 and 12 are flowcharts showing process procedures of the CPU 71 for the acceptance of the setting, storing and selection of the recipe. Note that the displaying process to the indicator 5 is omitted. The processes below are executed by the CPU 71 in accordance with the control program stored in the ROM 72 of the microcomputer 70 in advance.

The CPU 71 starts the process of FIG. 10 after the microwave oven is powered on and the initializing process is completed. Further, when waiting for an operation to the operation key, the processes of FIGS. 11 and 12 are started and are, when the processes end, restarted. The process of FIG. 10 is executed in parallel during the execution of the processes of FIGS. 11 and 12. Incidentally, stored in the RAM 73 of the microcomputer 70 are a "counter" for counting time after closing the door 2, a "timer FLG" for indicating that the time being counted, and a "key validity FLG" showing that the operation key is accepted validly.

In FIG. 10, the CPU 71 clears the "counter" (step S11) and clears the "timer FLG" (step S12) as a part of the initializing process. Thereafter, the CPU 71 determines whether or not the door switch 2*c* is off (step S13). If it is determined that the door switch 2*c* is off and, thus, it is detected that the door 2 opens (YES in step S13), the CPU 71 writes "3" into the "counter" for preparing for the time count after the door 2 closes (step S14). Then, the CPU 71 clears "key validity FLG" (step S15). This indicates that the acceptance of the operation key is invalid in the processes of FIGS. 11 and 12 described later. Then, the CPU 71 returns the process to step S13.

If determined in step S13 that the door switch 2*c* is not off, that is, the door 2 is closed (NO in step S13), the CPU 71 then determines whether the content of the "counter" is "0" which is subtracted by 1 every one second after the door 2 is closed (step S16). If determined that the content of the "counter" is "0" (YES in step S16), the CPU 71 sets the "key validity FLG" (step S17) and returns the process to step S13. This shows that the acceptance of the operation key is valid in the processes of FIGS. 11 and 12.

If determined that the content of the "counter" is not "0" (NO in step S16), the CPU 71 determines whether or not the "time FLG" is set (step S18). If determined that the "timer FLG" is not set (NO in step S18), the CPU 71 starts the one second timer which stops (step S19), sets the "timer FLG" (step S20), and returns the process to step S13.

If determined that the "timer FLG" is set in step S18 (YES in step S18), the CPU 71 determines whether the one second timer which has been started is up (step S21). If determined that the one second timer is not up (NO in step S21), the CPU 71 returns the process to step S13. If determined that the one second timer is up (YES in step S21), the CPU 71 clears the "timer FLG" (step S22). Then, the CPU 71 subtracts from the content of the "counter" by 1 (step S23), and returns the process to step S13.

Incidentally, in Embodiment 1, after it is detected that the door 2 is closed from which the door switch 2*c* is on, when the one second timer times out three times, the "key validity FLG" is set. However, the unit time the timer 74 counts is not limited to one second, and the number of times of time-outs is not limited to three.

In FIGS. 11 and 12, the CPU 71 calls a key input subroutine (step S31), and determines whether or not the numeric key 31 or 41 is pressed (step S32). If determined that neither the numeric key 31 nor 41 is pressed (NO in step S32), the CPU 71 determines whether or not the set memory key 33 is pressed (step S33). If determined that the set memory key 33 is not pressed, (NO in step S33), the CPU 71 executes another key process (step S34) and ends the process.

If determined in step S32 that the numeric key 31 or 41 is pressed (YES in step S32), the CPU 71 inputs the numeric value of the pressed numeric key 31 or 41 and stores it in the RAM 73 (step S35). Thereafter, the CPU 71 calls again the key input subroutine (step S36), and determines whether or not the start key 32 or 42 is pressed (step S37). If determined that the start key 32 or 42 is not pressed (NO in step S37), the CPU 71 returns the process to step S36 in order to wait for the key being pressed.

If determined that the start key 32 or 42 is pressed (YES in step S37), the CPU 71 reads the numeric value stored in the RAM 73 in step S35, and reads out the corresponding recipe from the nonvolatile area of the RAM 73 (step S38). Then, the CPU 71 executes the heating process known per se based on the read recipe (step S39), and ends the process. Incidentally, in a case of accepting the pressing of the stop/clear key 36 or 46 in the heating process, the heating process is to end.

If determined in step S33 that the set memory key 33 is pressed (YES in step S33), the CPU 71 calls the key input subroutine (step S41), and then determines whether or not the numeric key 31 or 41 is pressed (step S42). If determined that neither the numeric key 31 nor 41 is pressed (NO in step S42), the CPU 71 returns the process to step S41 in order to wait for the key being pressed.

If determined that the numeric key 31 or 41 is pressed (YES in step S42), the CPU 71 inputs the numeric value of the pressed numeric key 31 or 41 and stores it in the DRAM 73 (step S43). Thereafter, the CPU 71 calls the key input subroutine (step S44), and determines whether or not the time set key 34 is pressed (step S45). If determined that the time set key 34 is pressed (YES in step S45), the CPU 71 calls the key input subroutine (step S46), and determines whether or not the numeric key 31 or 41 is pressed (step S47).

If determined that the numeric key 31 or 41 is not pressed (NO in step S47), the CPU 71 returns the process to step S46 in order to wait for the key being pressed. If determined that the numeric key 31 or 41 is pressed (YES in step S47), the CPU 71 inputs the numeric value of the pressed numeric key 31 or 41, and stores a cooking time corresponding to the numeric value in the RAM 73 (step S48), and returns the process to step S44.

Incidentally, in Embodiment 1, a value obtained by multiplying the numeric value of the pressed numeric key by 10 is set to the cooking time on the second time scale; however, is not limited thereto, and for example, the combination of values of the minute time scale and the second time scale may be accepted as the cooking time.

If determined in step S45 that the time set key 34 is not pressed (NO in step S45), the CPU 71 then determines whether or not the power set key 35 is pressed (step S49). If determined that the power set key 35 is pressed (YES in step S49), the CPU 71 calls the key input subroutine (step S50), and determines whether or not the numeric key 31 or 41 is pressed (step S51). If determined that the numeric key 31 or 41 is not pressed (NO in step S51), the CPU 71 returns the process to step S50 in order to wait for the key being pressed. If determined that the numeric key 31 or 41 is pressed (YES in step S51), the CPU 71 inputs the numeric value of the pressed numeric key 31 or 41 and stores the heating power corresponding to the numeric value in the RAM 73 (step S52) and returns the process to step S44.

Incidentally, in Embodiment 1, a value is set to a heating value corresponding to the value, which is obtained by multiplying the maximum value of the heating power by a value obtained by dividing the value of the pressed numeric key by 10; however, is not limited thereto, and a value of W (watt) unit may be accepted as the heating power.

If determined in step S49 that the power set key 35 is not pressed (NO in step S49), the CPU 71 determines whether or not the set memory key 33 is pressed (step S53). If determined that the set memory key 33 is not pressed (NO in step S53), the CPU 71 returns the process to step S44. If determined that the set memory key 33 is pressed (YES in stop S53), the CPU 71 reads the numeric value, cooking time and heating power stored in the RAM 73 (step S54). Then, the CPU 71 makes the read numeric value correspond to the cooking time and the heating power, stores it as the recipe in nonvolatile area of the RAM 73 (step S55), and ends the process.

Figure 13:
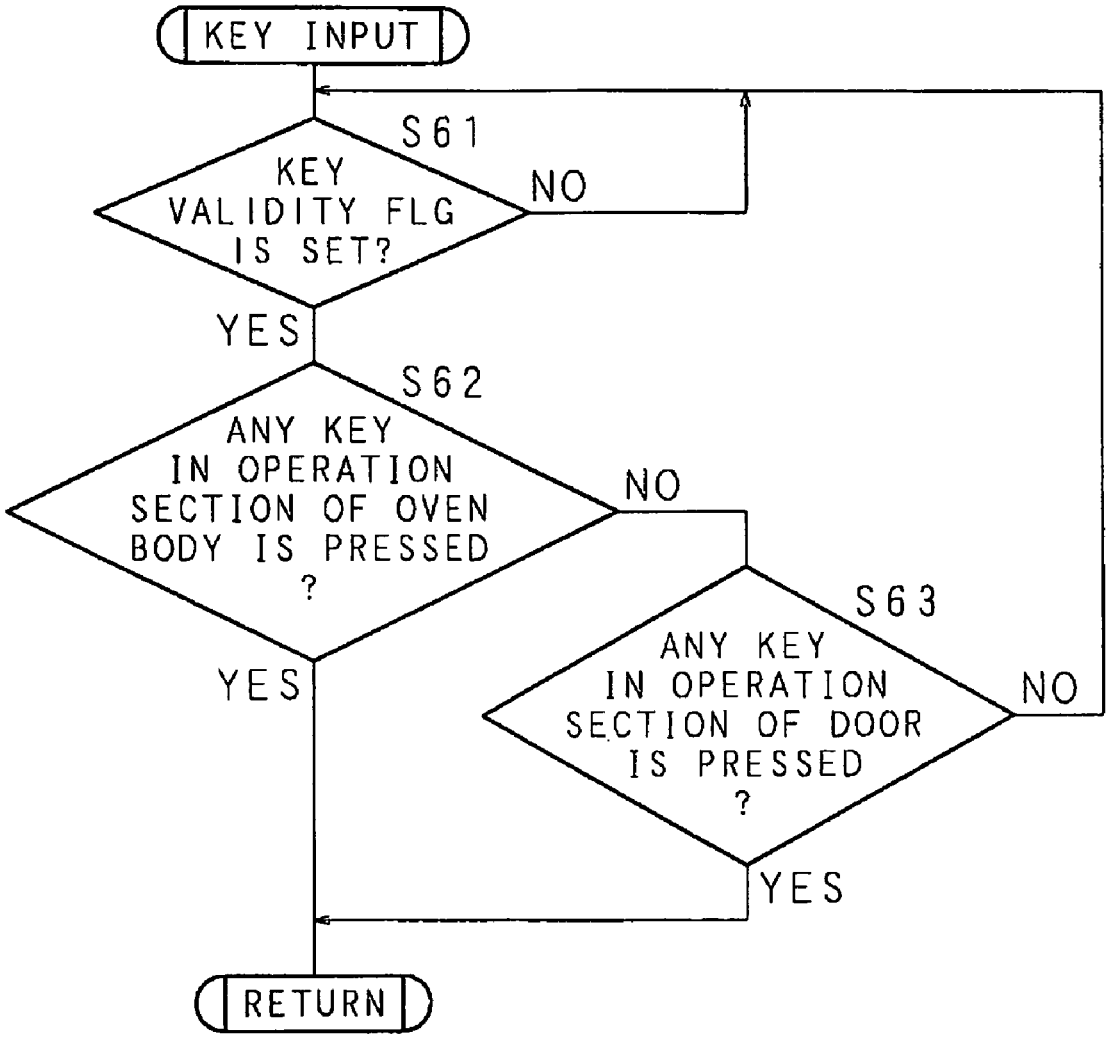
FIG. 13 is a flowchart showing a process procedure of the CPU in accordance with a subroutine which detects that the operation key of the operation section is pressed.

FIG. 13 is a flowchart showing a process procedure of the CPU 71 in accordance with a subroutine which detects that the operation key of the operation section 3 or 4 is pressed. The CPU 71 determines whether or not the "key validity FLG" is set (step S61). If determined that the "key validity FLG" is not set (NO in step S61), the CPU 71 waits until the "key validity FLG" is set.

If determined that the "key validity FLG" is set (YES in step S61), the CPU 71 determines whether or not any of the keys in the operation section 3 of the oven body 1 is pressed (step S62). If determined that any of the keys is pressed (YES in step S62), the CPU 71 ends the process of the subroutine and returns.

If determined that none of the keys are pressed (NO in step S62), the CPU 71 then determines whether or not any of the keys in the operation section 4 of the door 2 is pressed (step S63). If determined that any of the keys is pressed (YES in step S63), the CPU 71 ends the process of the subroutine and returns. If determined that none of the keys are pressed (NO in step S63), the CPU 71 returns the process to step S61.

As described above, according to Embodiment 1, there are provided the first operation section at the lower portion of the door, and the second operation section at the upper portion of the front face of the oven body to be exposed independently of the opening and closing of the door. This makes it possible to accept the operation to the respective operation sections independently of the opening and closing of the door, thereby increasing the total number and the degree of freedom of the arrangement of the keys included in the operation sections. Further, it can be intended that the keys included in the two operation sections separated vertically from each other are used in parallel or selectably in consideration of functions assigned to the keys and operability of the keys. Therefore, even when the door is closed, the respective operation sections can be used in parallel or selectably in accordance with the purpose of the operation and the posture of operator while in operation, allowing the arrangement of many keys to have good operability.

Further, both the first and second operation sections are provided with the numeric keys and the start keys redundantly. This makes it possible for any operation section to accept the selection from a plurality of recipes and the start of heating. Thus, for example, when it is difficult to operate one of the operation sections, a user can operate the selection of the recipe and the start of heating with the other operation section.

Further, to the second operation section, provided is a set memory key for assigning the functions to other keys. Accordingly, only the second operation section can accept assigning the functions to other keys. Thus, for example, it is possible to provide keys for assigning the functions to other keys only to the second operation section which the manager operates.

Specifically, with the assumption for the microwave oven used in a professional-use kitchen, the main user or chef operates exclusively the first operation section which is positioned at a height close to the cooking table on which the microwave oven is placed, and the two operation sections can be provided with different functions. That is, to the first operation section arranged at the lower portion of the door, provided are at least the start key for heating and the numeric keys for quickly selecting the recipe (heating time and heating power) matching a target cooking with the numeric value corresponding to the recipe. In this case, the manager operates the second operation section arranged at the upper portion of the front face of the oven body, and the second operation section is provided with, in addition to the numeric keys and the start key for heating included in the first operation section, keys for the manager assigned with the functions such as setting and changing the functions for the manager.

In this way, the manager key is provided only in the second operation section positioned at the height obviously different from that of the first operation section to give a difference between the functions of the two operation sections and discriminate the operation sections operated by the chef and the manager, thereby preventing a case where the chef operates the manager key by mistake making cooking impossible and having to call the manager. Further, the chef is not distracted from his or her work due to fear of causing an accidental operation since there is no manager key in the first operation section which he/she operates exclusively, improving working efficiency preferably.

Further, when the CPU detects the opening of the door by the state that the door switch is off, the operation to the first operation section is made invalid. This makes it impossible to accept the operation to the first operation section in the case of the door being opened. Therefore, for example, even when the user opens the door, safety is secured in the case of touching the key in the operation section by mistake.

Still further, the CPU detects the closing of the door by the state that the door switch is on, the operation to the first operation section is made invalid until three seconds are counted after closing the door. This makes it impossible to accept the operation to the first operation section for only three seconds in the case of the door being closed. Therefore, for example, even when the user closes the door, safety is secured in the case of touching the key in the operation section by mistake.

Incidentally, in Embodiment 1, the manager key described above is provided to the second operation section arranged at the upper portion of the oven body. However, the manager key may be provided to the first operation section arranged at the lower portion of the door. Further, it may be configured that the operation keys included in the first and second operation sections entirely are replaceable physically.

Embodiment 2

In Embodiment 2, an microwave oven as the cooking device has the operation keys where, different from Embodiment 1 in which only one of the two operation sections has the operation keys where the functions for the manager can be assigned, an operation section (first operation section) 4 arranged at the lower portion of a door 2 and an operation section (second operation section) 3 arranged at the upper portion of an oven body 1 can both be assigned with the functions for the manager.

Figure 14:
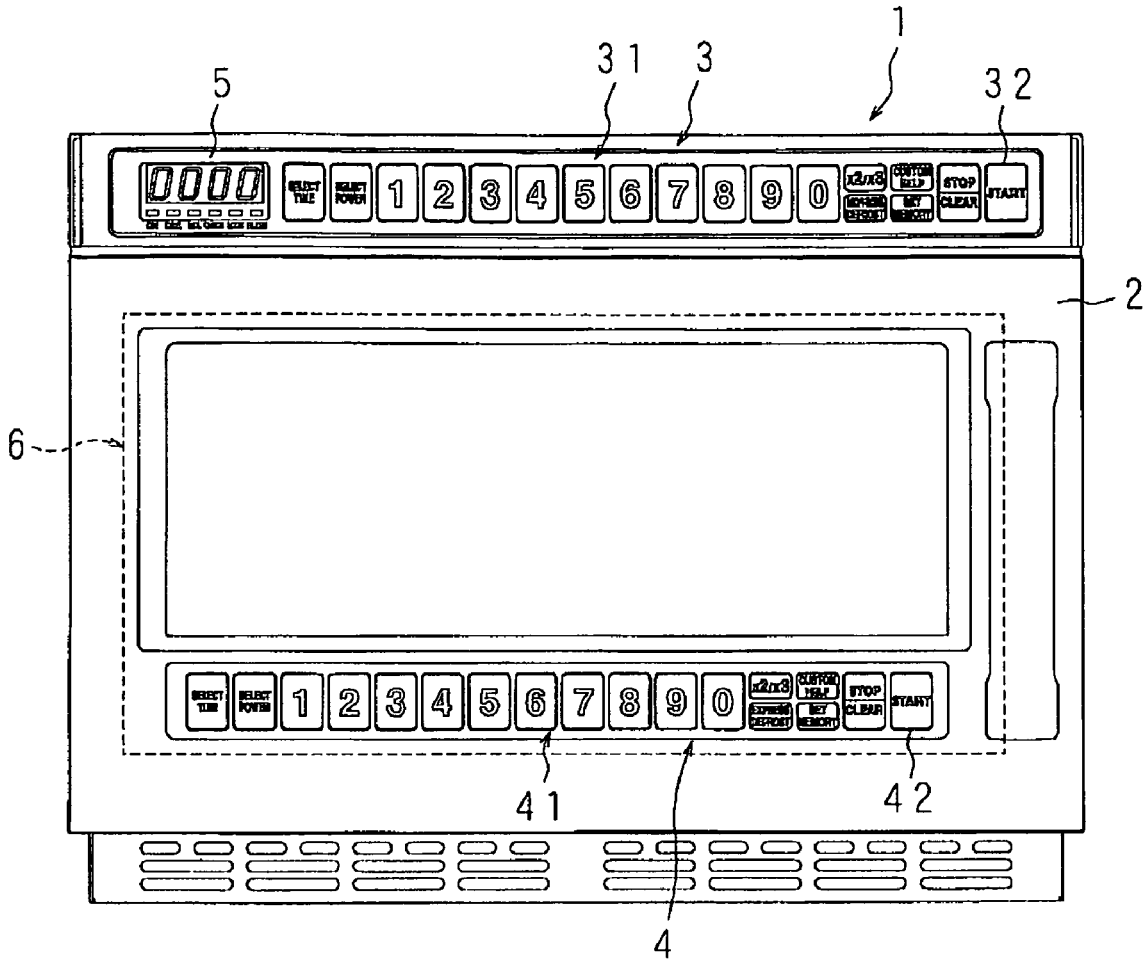
FIG. 14 is a front view showing an appearance of a microwave oven according to Embodiment 2 of the invention.
Figure 15:
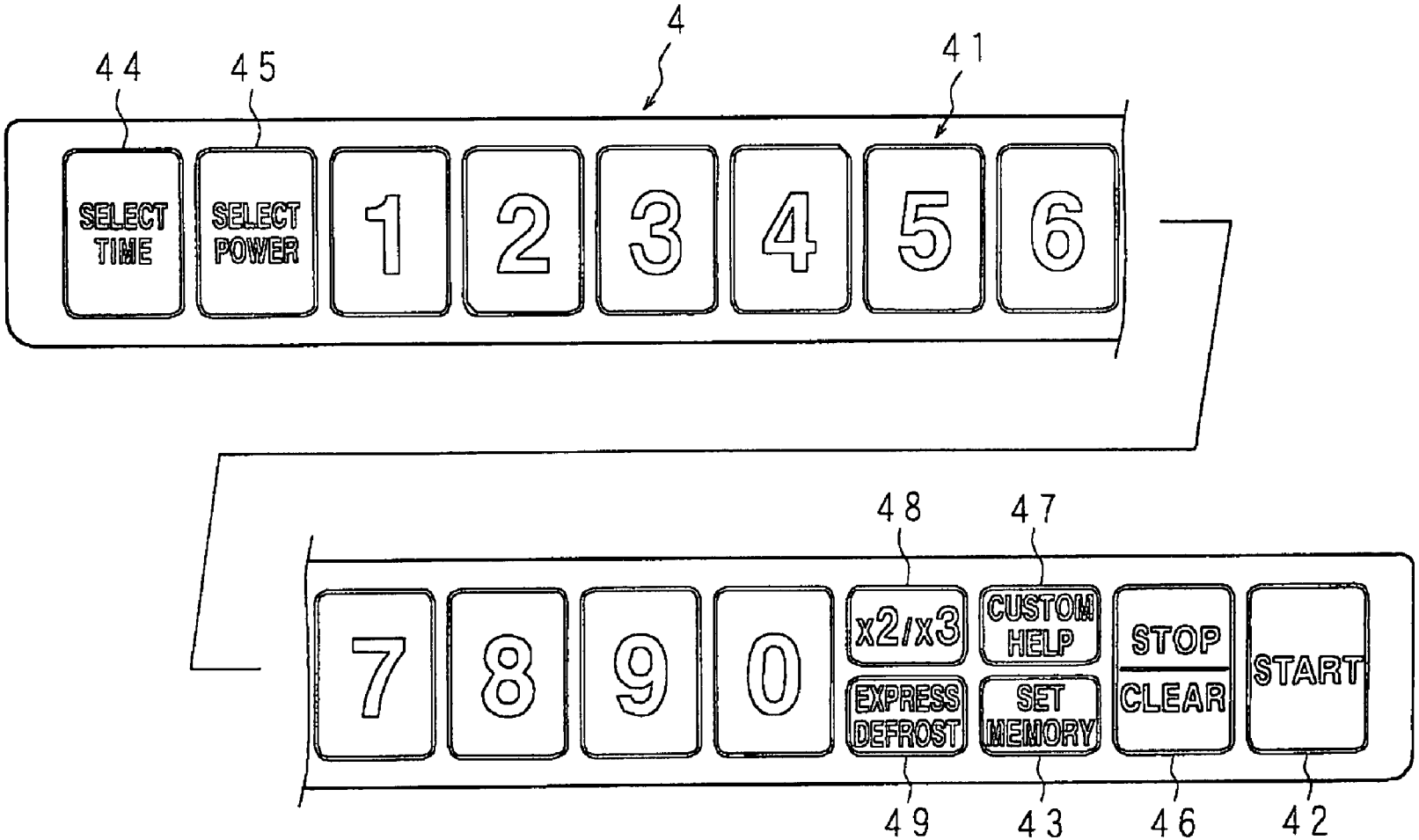
FIG. 15 is an illustration showing an appearance of an operation section arranged at a door of the microwave oven according to Embodiment 2.

FIG. 14 is a front view showing an appearance of the microwave oven according to Embodiment 2 of the invention, and FIG. 15 is an illustration showing an appearance of the operation section 4 arranged at the door 2 of the microwave oven according to Embodiment 2 of the invention. The operation section 4 includes numeric keys 41 having keys from "0" to "9" for accepting the selection from the recipes stored in advance, and a start key 42 and a stop/clear key 46 for accepting the start and stop of heating respectively for the recipe corresponding to the numeric value selected with the numeric key 41. The operation section 4 also includes, as the operation keys to which the functions for the manager can be assigned, a set memory key 43, a time set key 44, a power set key 45, a help key 47, a twice/thrice set key 48 and an express defrosting key 49.

Among the operation keys included in the operation sections 3 and 4, as for the numeric keys 31 and 41, the start keys 32 and 42, and the stop/clear keys 36 and 46, the pressing of any key from both operation sections is accepted. However, as for other operation keys to which the functions for the manager may be assigned, the pressing of only a key which is set to be for the manager in advance may be accepted. Incidentally, immediately after an initialization, the operation section 3 is set for the manager and assigned with the function for the manager.

Specifically, when the first (or second) operation section is set for the manager, in step S62 (or step S63) of a subroutine for detecting the pressing of the operation key shown in FIG. 13, it is not determined that other operation keys described above are pressed. Further, in steps S33, S45, S49 and S53 in the flowcharts shown in FIGS. 11 and 12, the CPU 71 determines whether or not the set memory key 33 or 43, the time set key 34 or 44, the power set key 35 or 45, and the set memory key 33 or 43 are pressed.

Other components corresponding to those of Embodiment 1 are denoted with similar reference numerals, and the detailed descriptions thereof are omitted.

As described above, according to Embodiment 2, both the first and second operation sections are provided with the specific operation key to which the function for the manager can be assigned, and only the operation section set for the manager accepts the pressing of the specific operation key. This makes it possible to replace the operation sections operated by the chef and the manager by setting.

For example, in a case of placing one microwave oven on top of another one, when the first operation section arranged at the lower portion of the door is set as the operation section for the chef for respective microwave ovens of the upper and the lower, the chef can be given the identical operability for any microwave oven for the upper and the lower. Therefore, the chef can intuitively and easily memorize key operations. Further, when the first operation section of the upper microwave oven and the second operation section of the lower microwave oven are set as the operation sections for the chef, the two operation sections the chef operates can be closed above and below. Thus, the chef may only shift vertically his/her eyes slightly avoiding decreased attention.

Incidentally, in Embodiments 1 and 2, the recipe corresponding to the numeric value of the numeric key is read and heating is started in the case for accepting the pressing of the start key subsequent to the pressing of the numeric key. However, when two or more numeric keys are pressed continuously and then the pressing of the start key is accepted, the recipe corresponding to the numeric value of the numeric key pressed last may be read and heating may be started. In this way, acceptance of the pressing of the numeric key with priority placed on the later pressed key makes it possible to accept, in a case of finding the numeric key pressed previously incorrect before the user presses the start key, the correct numeric key pressed thereafter and the start key. Therefore, the user does not need to press the stop/clear key to correct the numeric key, suppressing the decrease in working efficiency.

Further, the starting of heating is not limited to a case for accepting that the numeric key is pressed and subsequently the start key is pressed. However, it may be that immediately after accepting the pressing of the numeric key, the recipe corresponding to the numeric value of the numeric key is read, and the heating is started (so-called automatic start). In this case, when the user presses an incorrect numeric key, it is necessary for the stop/clear key to be pressed to stop heating at once, and then the correct numeric key to be pressed. Thus, it is considered that working efficiency may be decreased compared with the case where the heating is started by pressing the start key. When input error occurrence is estimated to be reasonably low because the users perform self-checking the numeric display when depressing a numeric key by visual inspection as a practice, it shall be efficiency-wise preferable to make automatic start user-selectable.

Still further, in the subroutine for detecting the pressing of the operation key shown in FIG. 13, it may be during the waiting until the key is pressed, the process ends when a time-out of a predetermined time period or the pressing of the stop/clear key is detected.

Further, when accepting the set memory key, for example, the user may be prompted to input a password registered in advance. In this case, since data which can be inputted from the operation section is only the numerals of the numeric key, the password which can be accepted is also limited to only a combination of the numerals. However, in a case where the purpose of the password input is for preventing the operation for setting or changing the functions from being performed carelessly by a person other than the manager, the password does not need to be a complex one combined with characters such as the alphabet, whereby the purpose may be achieved by a password of a numeric combination.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A microwave cooking device, comprising:

a microwave cooking device body including therein a heating chamber having a door for openably closing the heating chamber and a heating section for heating by microwave an object to be heated inside the heating chamber; and two operation sections for accepting an operation to control the heating section;

wherein the operation sections include a first operation section provided to a front face of the door, and a second operation section provided to a front face of the microwave cooking device body so as to be exposed in spite of the door being opened and closed, wherein the first operation section is provided in a lower portion of the door and extending substantially in a horizontal direction, and the second operation section is provided in an upper portion of the microwave cooking device body and extending substantially in the horizontal direction, and wherein the first and second operation sections each has at least a plurality of operation switches assigned with identical functions, said first and second operation sections are redundantly arranged in an identical layout, respectively, wherein one of the first and second operation sections has an operation switch assigned with a function that is not assigned to an operation switch of the other of the first and second operation sections.

2. The cooking device of claim 1, wherein the identical function is a selection of a recipe or start of heating.

3. The cooking device of claim 1, wherein the function that is not assigned to the operation switch of the other of the first and second operation sections is to assign a function to the operation switch of the other of the first and second operation sections.

4. The cooking device of claim 1, further comprising:

a detecting section for detecting opening and closing of the door; and an invalidating section for invalidating the acceptance of the operation to the first operation section when the detecting section detects the door being opened.

5. The cooking device of claim 4, further comprising:

a time counting section for starting a time count when the detecting section detects the door being closed; and a relay that opens and closes a relay contact for selectively supplying power to the heating section, wherein the invalidating section invalidates the acceptance of the operation to the first operation section until the time counting section counts a predetermined time period from the starting of the time count by operating the relay to open the relay contact.

6. The cooking device of claim 1, wherein a memory key for assigning a function of a key in the other of the first and second operating sections is located at the second operation section.

* * * * *